United States Patent [19]

Nava

[11] Patent Number: 4,731,885

[45] Date of Patent: Mar. 22, 1988

[54] DEVICE FOR DIVIDING THE AIR FLOW ENTERING IN A HELMET INTO A CENTRAL UPWARD FLOW AND TWO LATERAL FLOWS

[75] Inventor: Pier L. Nava, Bergamo, Italy

[73] Assignee: Nava & C. S.p.A., Italy

[21] Appl. No.: 61,462

[22] Filed: Jun. 15, 1987

[30] Foreign Application Priority Data

Jul. 1, 1986 [IT] Italy ..... 22424/86[U]

[51] Int. Cl.[4] ..... A42B 3/02

[52] U.S. Cl. ..... 2/424; 2/171.3; 2/436

[58] Field of Search ..... 2/6, 7, 10, 171.3, 410, 2/424, 425, 436, 437; 98/1

[56] References Cited

U.S. PATENT DOCUMENTS

| | | | |
|---|---|---|---|
| 4,498,202 | 2/1985 | Yamamoto | 2/424 |
| 4,538,303 | 9/1985 | Schnitzler | 2/424 |
| 4,612,675 | 9/1986 | Broersma | 2/424 |
| 4,615,052 | 10/1986 | Hava | 2/424 |
| 4,667,348 | 5/1987 | Sundahl | 2/424 X |

*Primary Examiner*—Harold Joyce

*Attorney, Agent, or Firm*—Harness, Dickey & Pierce

[57] ABSTRACT

A device to direct on the vizor the central part of the air flow entering from the helmet's front grating, while the other two air flows entering through lateral slots (12,12') are directed sidewise. The entry of the lateral air flows can be adjusted by means of hinged valves (30) made of flexible plastic material, the hinged ends of said valves being oriented toward the center line of the helmet, the valves being shifted by sliders (50) engaging with inclined plane (34) of the valves themselves.

4 Claims, 6 Drawing Figures

DEVICE FOR DIVIDING THE AIR FLOW ENTERING IN A HELMET INTO A CENTRAL UPWARD FLOW AND TWO LATERAL FLOWS

DESCRIPTION

This invention relates to a device comprising a flexible flapper valve to control the inlet and interception of lateral ventilating air in motorcyclist's helmets.

In protective helmets, particularly for motorcyclists, the air for internal ventilation is caused to flow through a front grating in the helmet body, near the user's jaw. The air flow is controlled by a damper which may be actuated by a lever sliding horizontally, and said air flow is usually totally directed on the visor.

While such a solution is effective for the visor, it needs to be integrated with other lateral devices apt to introduce symmetrically two practically horizontal air flows to cool the users' head, said air rising along the helmet's internal comfort padding toward one or more discharge openings.

The addition of said lateral devices complicates the construction of the helmets and increases their cost; other difficulties are involved in providing such lateral openings, for example, in the presence of the helmets' movable collar.

The scope of the invention is to divide the air flow entering the helmet from the front grating, utilizing a center part upwardly to ventilate the visor while the other two lateral parts of the air flow are directed horizontally thereby eliminating to provide further lateral apertures in the helmet.

According to this invention, the rear part of the front air inlet grate is provided with two flapper valves hinged symmetrically to the sides of a central chamber opened only upwardly, each one of said valves being independently controlled through a slider operating horizontally and acting on an inclined plane as a cam, to lift the end of the air inlet valve.

The invention will now be explained, by way of example only, in conjunction with the annexed drawings.

Figure 1:
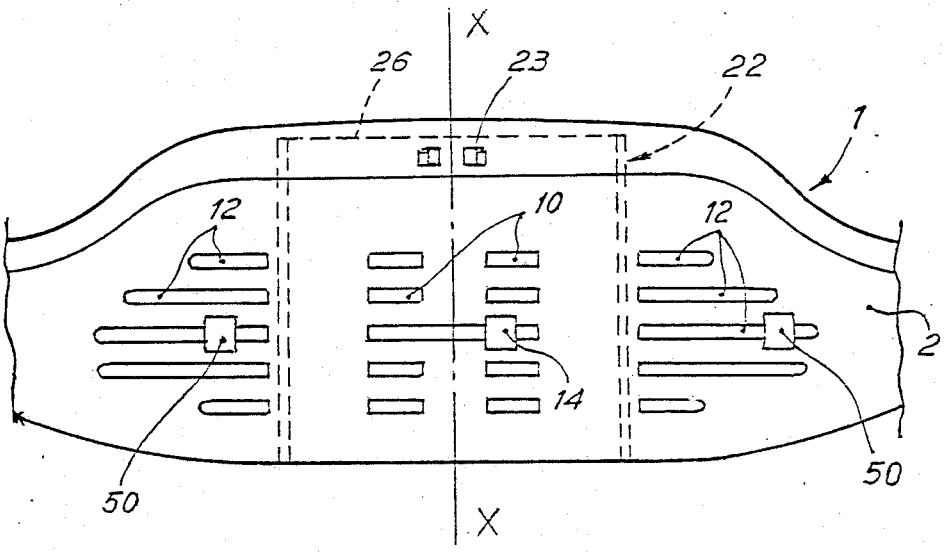
FIG. 1 is a front view of the air inlet grate of a helmet provided with the control sliders for the device according to the invention.

In FIG. 1, helmet 1 is provided, on its front part 2, facing the users' chin, with a set of central slots 10 and side slots 12 and 12'.

The air entering via center slots 10 can be controlled at will by the wearer through a slider 14 which may be shifted horizontally to move a rear plate of known type provided with apertures which can coincide or not with said slots.

Figure 2:
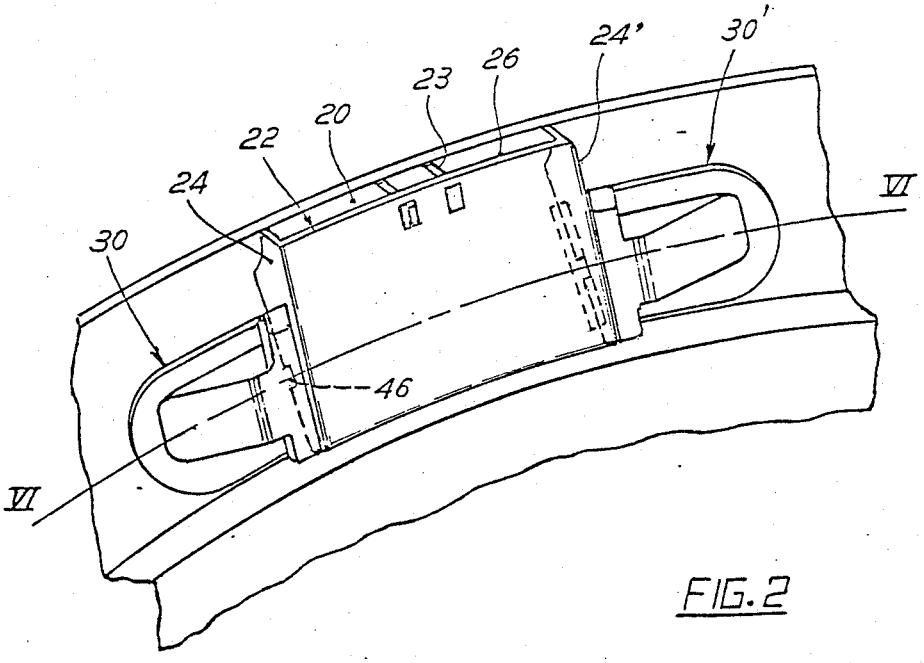
FIG. 2 is a perspective view of the rear part of the grate of FIG. 1, showing the device according to the invention.

The air entering only from front center slots 10 is led into a chamber 20 (see FIGS. 2 and 6) consisting of a semi-box 22 secured by snap action to the helmet's wall and delimited by side walls 24 and 24'.

Said semi box forms an aperture 26 oriented upwardly to deviate a laminar air stream onto the visor, to avoid fogging. The air entering through slots 12 and 12' serves instead to ventilate the wearer's head, rising through the open cell type foam padding and network of channels, up to the air discharges located on top of the helmet.

Figure 3:
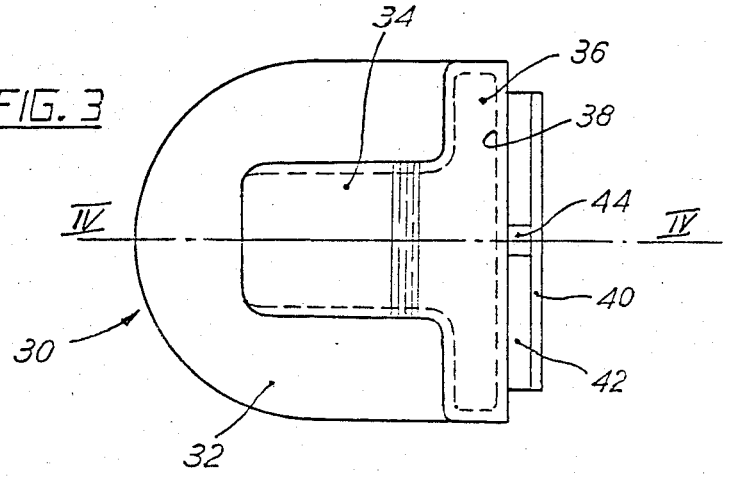
FIG. 3 is a top view of one of the flapper valves of the device.
Figure 4:
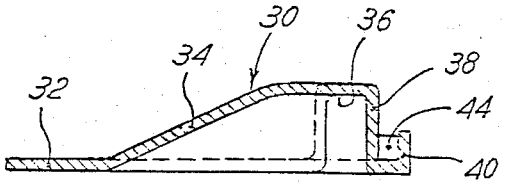
FIG. 4 is a cross section on lines IV—IV of the valve of FIG. 3.
Figure 5:
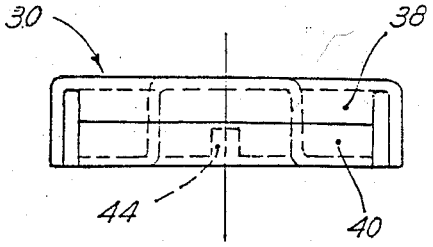
FIG. 5 is a rear elevation view of the value of FIGS. 3 and 4.

To direct the air streams sidewise, two flapper valves 30 and 30' are provided; these may be secured to walls 24 and 24' to form a hinge as will now be explained. Valves 30 (see FIGS. 3,4,5), made of flexible plastic material obtained by stamping, consist of a base lamina 32, the center of which is provided with a drawn part 34 forming an inclined plane which connects with a hollow transversal rib 36 terminating with a wall 38.

The latter, at the level of lamina 32 folds twice outwardly to form a hook 40 delimiting a groove 42 the mid part of which is linked by a staple 44.

Figure 6:
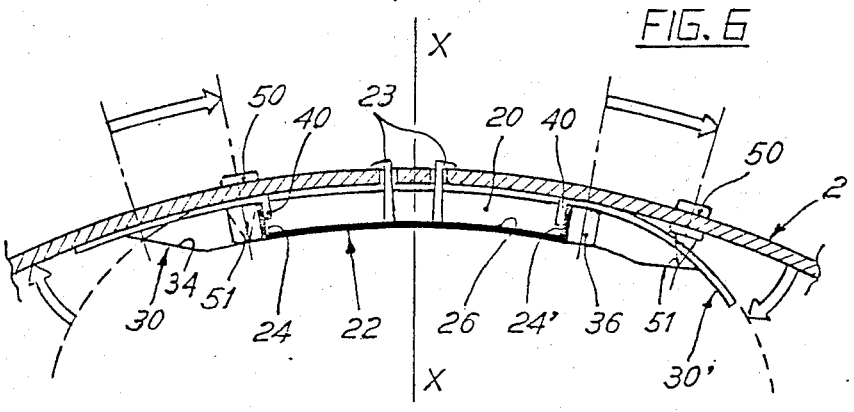
FIG. 6 is a cross section of the device taken on line VI—VI of FIG. 2, half showing the valve in open position and the other half showing the valve in its closed position.

Said valves are easily hooked to walls 24 or 24' of central semi box 22 so that the staple 44 enters in notch 46 of each one of said walls 24, 24' while hook 40 embraces the wall itself to form a hinge as it can be clearly seen in FIG. 6.

The opening and closing action of valves 30, 30' can also be observed in the same figure. Precisely, in the left half of the drawing, slider 50 is brought toward the center line X—X of the helmet, and by entering with its internal end 51 in the drawn part of the valve, enables the latter to adhere elastically to the helmet's inner wall and close slot 12. Vice versa, by shifting the slider sidewise, as shown in the right hand side of the figure, the end 51 of the slider engages an inclined plane 34 of the drawn part forcing the valve to open for inlet of the air.

The device described advantageously performs the function of independently opening and closing continuously the conditioning air flows for the helmet operating the adjustable slider to distribute the air flow as desired by the wearer.

Moreover, the flapper valves, due to their position, can direct the flow in the required direction.

I claim:

1. Device to ventilate helmets, in particular motorcyclists' helmets, the front of the helmet being provided in its lower part with a set of parallel slots communicating with the interior of the helmet characterized by a central box shaped body opened upwardly to deviate the air flow on the visor and provided by interception means to control air flow, and by two flapper valves fitted laterally with respect to said central body, each to deviate and to control an air flow sidewise of the helmet, said valves consisting of an elastic lamina made of flexible plastic material and being hinged on the lateral walls of said central box shaped body.

2. Device according to claim 1, characterized in that each of said intercepting flapper valves is provided in its center with a drawn part which forms an inclined plane, the higher end of which is connected to a transversal stiffening rib whose wall opposite to said inclined plane is folded over twice to form a groove within which can engage a wall of the central box shaped body to which one of said valves is secured by hinging.

3. Device according to claim 2, characterized in that said groove is provided, substantially at its center, with a staple engaging with a corresponding notch on said wall to secure said valve and for centering it.

4. Device according to claim 3, characterized in that sliders for the opening of said valves engage with their ends, in the drawn parts of the valves so that, when said sliders lean toward the center of the helmet the valves adhere internally to slots of the set of parallel slots to inhibit air inlet and when the sliders are shifted laterally, their end engages with said inclined plane of the drawn part to open progressively the entry of the air which is thus directed sidewise toward the wearer's head.

* * * * *